US008274205B2

(12) United States Patent
Wilson et al.

(10) Patent No.: US 8,274,205 B2
(45) Date of Patent: Sep. 25, 2012

(54) SYSTEM AND METHOD FOR LIMITING ARC EFFECTS IN FIELD EMITTER ARRAYS

(75) Inventors: Colin R. Wilson, Niskayuna, NY (US); Ji-Ung Lee, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 604 days.

(21) Appl. No.: 11/567,095

(22) Filed: Dec. 5, 2006

(65) Prior Publication Data

US 2008/0129177 A1 Jun. 5, 2008

(51) Int. Cl.
*H01J 1/02* (2006.01)

(52) U.S. Cl. ..... 313/309; 313/495; 313/310; 313/336; 313/351

(58) Field of Classification Search ..... 313/495–497, 313/309–311, 336, 346 R, 351
See application file for complete search history.

(56) References Cited

U.S. PATENT DOCUMENTS

| | | | | |
|---|---|---|---|---|
| 6,008,576 | A * | 12/1999 | Nakatani et al. | 313/495 |
| 6,013,986 | A * | 1/2000 | Knall et al. | 315/169.3 |
| 6,670,629 | B1 | 12/2003 | Wilson | |
| 6,750,470 | B1 | 6/2004 | Wilson | |
| 2001/0035706 | A1 * | 11/2001 | Raina et al. | 313/309 |
| 2003/0094892 | A1 * | 5/2003 | Moradi et al. | 313/495 |
| 2004/0036399 | A1 * | 2/2004 | Raina et al. | 313/309 |
| 2004/0090172 | A1 * | 5/2004 | Ide et al. | 313/497 |
| 2004/0108804 | A1 * | 6/2004 | Hsu | 313/495 |
| 2007/0029918 | A1 * | 2/2007 | Raina et al. | 313/495 |

FOREIGN PATENT DOCUMENTS

EP 0696042 B1 12/1999

OTHER PUBLICATIONS

C. Spindt et al., "Physical Properties of Thin-Film Field Emission Cathodes with Molybdenum Cones," Journal of Applied Physics, vol. 47, No. 12, Dec. 1976.

French Search Report dated Dec. 10, 2010 and Written Opinion.

Parameswaran et al., "Resistive Arc Protection for Field-Emitter-Array Cold Cathodes Used in X-Band Inductive Output Amplifiers", MIT Lincoln Laboratory, Lexington, MA 02173-9108, 10.1109/IVMC, 1998-728679 Vacuum Microelectrpmocs Cpmferemce. 1998 Eleventh International, pp. 136-137,1998.

* cited by examiner

*Primary Examiner* — Anh Mai
*Assistant Examiner* — Kevin Quarterman
(74) *Attorney, Agent, or Firm* — Scott J. Asmus

(57) ABSTRACT

The system and method provided herein for limiting the effects of arcing in field-type electron emitter arrays improves the robustness of such arrays. Field-type electron emitter arrays generally have a substrate, an insulator, and a gating electrode. By including a resistive substance in the gate of the emitter array, arcing events may be isolated to a single emitter such that the remaining emitters of an array can continue electron emission and/or the short circuit current of the arc can be limited.

14 Claims, 2 Drawing Sheets

SYSTEM AND METHOD FOR LIMITING ARC EFFECTS IN FIELD EMITTER ARRAYS

BACKGROUND OF THE INVENTION

The present invention relates generally to field-type electron emitters, and, more particularly, to a system and method for limiting the effects of arcing in field-type electron emitter arrays. By including a resistive substance in the gate layer of an emitter array, arc current through a given emitter can be limited and neighboring emitters can maintain electron emission. A more robust field emitter array is thus achieved.

Electron emissions in field-type electron emitter arrays are produced according to the Fowler-Nordheim theory relating the field emission current density of a clean metal surface to the electric field at the surface. Most field-type electron emitter arrays generally include an array of many field emitter devices. Emitter arrays can be micro- or nano-fabricated to contain tens of thousands of emitter devices on a single chip. Each emitter device, when properly driven, can emit a stream or current of electrons from the tip portion of the emitter device. Field emitter arrays have many applications, one of which is in field emitter displays, which can be implemented as a flat panel display. In addition, field emitter arrays may have applications as electron sources in microwave tubes, x-ray tubes, and other microelectronic devices.

The electron-emitting field emitter devices themselves may take a number of forms. FIG. 1 depicts an example of a common type of field emitter 10 known as a "Spindt"-type emitter. Emitter 10 includes a conductive substrate 12, which is often a heavily doped silicon-based substance. On the substrate 12 is grown a layer of silicon dioxide ($SiO_2$) 14, to act as an insulator. A metal film 16, usually of molybdenum (Mb), is laid over the silicon dioxide 14, to form a conductor-insulator-conductor cross-section. Typically, the metal layer 16 is etched to form a hole 22 therethrough, and the silicon-dioxide 14 is dissolved to form a cavity 20 into which a emitter cone or tip 18 is placed. Emitter tip 18 is typically also formed of molybdenum.

In operation, a control voltage 24 is applied across metal layer 16 and substrate 12, creating a strong electric field near opening 22. Thus, metal layer 16 acts as a gating electrode for the emission of electrons from emitter tip 18. Typically, metal layer 16 is common to all emitters of an emitter array and supplies the same control or emission voltage to the entire array. In some Spindt emitters, the control voltage may be about 100V. Because of the conical shape of emitter tip 18, the interaction of the tip 18 and the electric field near opening 22 is focused at a smaller point and electron emission 26 is more easily achieved. However, many other shapes and types of emitter cones or tips may be used in Spindt emitters and other emitter device types. Other types of emitters may include refractory metal, carbide, diamond, or silicon tips or cones, silicon/carbon nanotubes, metallic nanowires, or carbon nanotubes.

At present, field emitter arrays are not known to be robust enough for use in several potential commercial applications, such as for use in x-ray tubes. Many existing emitter array designs are susceptible to operational failures and structural wear from electrical arcing. Arcing may be more likely to occur in the high pressures which exist in many x-ray tubes. Most commonly, an overvoltage applied to metal layer 16 of the emitter 10 of FIG. 1 may cause an arc to form between the metal layer 16 and the emitter tip 18, permitting current to flow in a short circuit from the metal layer 16 through the emitter tip 18 to the substrate 12. Another type of arcing is known as surface flashover arcing, in which an overvoltage applied to metal layer 16 can cause a breakdown of the silicon dioxide insulating layer 14 which allows current to punch through, creating a short circuit between the metal layer 16 and substrate 12. The arc can also pass over the surface of the silicon dioxide insulating layer, resulting in what is known as a "flash over"

When one emitter of an emitter array experiences arcing in either form, or "breaks down," the metal layer will no longer be able to support a voltage or electrical bias sufficient for electron emission to continue at the other emitters of the array. In addition, high temperatures produced by the short circuit current can cause wear or damage to the emitter as well as neighboring emitters. Thus, an arc at one emitter can affect the operation of the entire emitter array.

It would therefore be desirable to have a system and method which protect an emitter array from the effects of arcing. It would be further desirable for such a system and method to protect both the operation and structure of the array by maintaining the emission or control voltage at non-arcing emitters and limiting the arc current of the arcing emitter.

BRIEF DESCRIPTION OF THE INVENTION

The present invention provides a system and method for overcoming the aforementioned drawbacks. In particular, embodiments of the present invention include a gate layer which limits short circuit arc current and supports an emission bias at non-arcing emitters even when one emitter is experiencing arcing.

Therefore, in accordance with one aspect of the invention, a field emitter array includes a substrate layer, a gate layer, and a dielectric layer therebetween. The gate layer has a plurality of openings formed therethrough and the dielectric layer has a number of recesses therein. An emitter is disposed in each of the recesses of the dielectric layer and each emitter is designed to emit electrons when an emission voltage is applied across the gate layer and the substrate layer. The gate layer includes a substance with an electrical resistance which localizes arcing effects of the array.

In accordance with another aspect of the invention, a method of manufacturing a field emitter is disclosed. The method includes providing a substrate base, depositing a dielectric on the substrate base, and forming a gate on the dielectric. A number of channels are created through the gate and the dielectric, and an electron emitter tip is positioned in each channel. The gate is arranged to maintain electron emission from a number of the electron emitter tips when one electron emitter tip experiences a short circuit.

In accordance with a further aspect of the invention, an electron stream generator includes a controller configured to selectively apply a potential across a gate and a substrate. The gate is positioned to create an electric field sufficient to cause electron emission from a given emitter element when the potential is being applied. A resistive substance is also included, and intervenes between the gate and the given emitter element.

Various other features and advantages of the present invention will be made apparent from the following detailed description and the drawings.

BRIEF DESCRIPTION OF THE DRAWINGS

The drawings illustrate one embodiment presently contemplated for carrying out the invention.

In the drawings.

DETAILED DESCRIPTION OF THE PREFERRED EMBODIMENT

Figure 1:
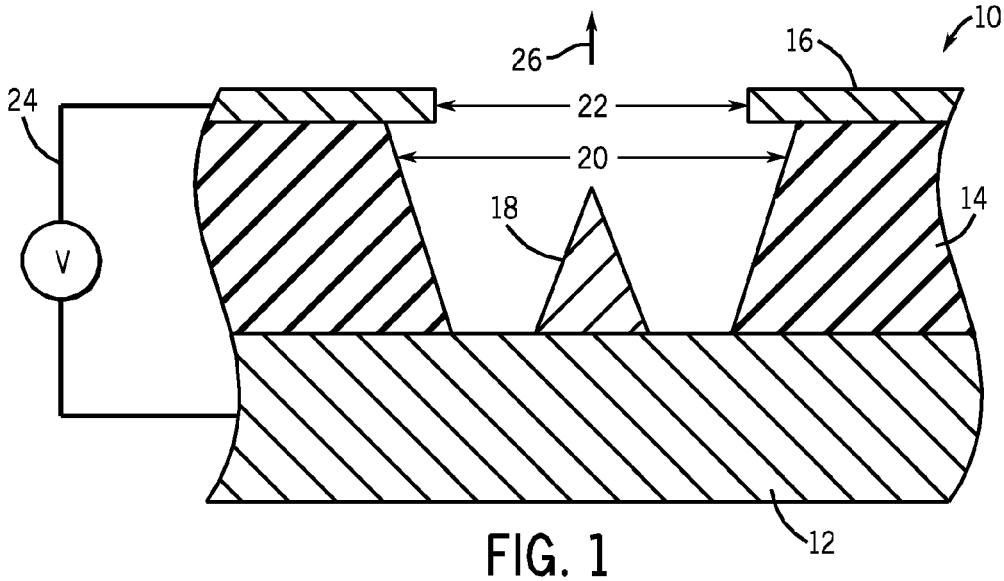
FIG. 1 (PRIOR ART)
FIG. 1 is a cross-sectional view of a known field emitter.
Figure 2:
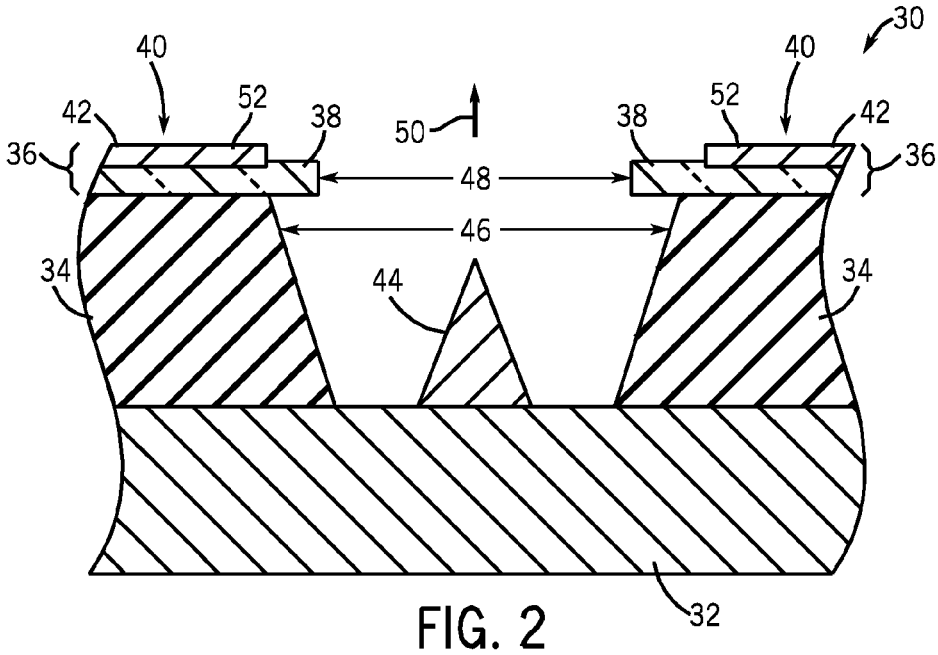
FIG. 2 is a cross-sectional view of a field emitter in accordance with an embodiment of the present invention.

Referring to FIG. 2, a cross-sectional view of a single field emitter 30 of a field emitter array is shown. Preferably, in one embodiment, field emitter 30 is a Spindt-type emitter, though it is understood that the features and adaptations described herein are also applicable to other types of field emitters. In the embodiment shown, a substrate layer 32 forms a base of the emitter. Substrate layer 32 may be formed of a conductive or semiconductive substance, such as silicon- or metal- based substances. An insulating or dielectric layer 34 is formed or deposited over substrate layer 32. Dielectric layer 34 may be a non-conductive substance or a substance of a very high electrical resistance, such as silicon dioxide ($SiO_2$) or silicon nitrate (SiN). Dielectric layer 34 is used to separate the substrate layer 32 from a gate layer 36, so that an electrical potential may be applied between gate layer 36 and substrate 32.

A channel or cavity 46 is formed in dielectric layer 34, and a corresponding opening 48 is formed in gate layer 36. As shown, opening 48 substantially overlaps cavity 46. In other embodiments, cavity 46 and opening 48 may be of approximately the same diameter, or cavity 46 may be narrower than opening 48 of gate layer 36. Therefore, in manufacture, cavity 46 may be created in dielectric layer 34 before gate layer 36 is formed thereon. Alternatively, opening 48 and cavity 46 may be created after gate layer 36 has been formed.

An electron emitter 44 is disposed in cavity 46, affixed on substrate layer 32. As shown, emitter 44 is of a conical shape to focus the interaction of an electrical field of opening 48 with the emitter 44, for ease of electron emission. Thus, when a control voltage is applied thereto, emitter 30 generates an electron stream 50 therefrom, which may be used for a variety of functions. In one embodiment, emitter 44 is a molybdenum (Mb) cone. However, it is contemplated that the system and method described herein are also applicable to emitters formed of several other materials and shapes used in field-type emitters, such as carbon nanotubes.

Gate layer 36 includes a highly resistive layer 38 and a highly conductive layer 40. In one embodiment, resistive layer 38 may be a semiconductor layer and conductive layer 40 may be a lithographed or printed metal layer. Resistive layer 38 may be formed by using plasma-enhanced chemical vapor deposition or "PECVD"-doped amorphous silicon, which may be n-type or p-type. In such an embodiment, the conductivity of resistive layer 38 may be accurately controlled by the amount of dopant, such as phosphorus (P) for an n-type semiconductive layer or boron (B) for a p-type semiconductive layer. Conductive layer 40 may preferably be formed of molybdenum or other metals suitable for use as gating electrodes in field emitters. Resistive layer 38 and conductive layer 40 are electrically connected, though resistive layer 38 is of a significantly higher electrical resistance than conductive layer 40. One standard method for forming conductive layer 40 onto resistive layer 38 is known as a metal-lift off process. Conductive layer 40 includes a surrounding portion 52 which extends about the periphery of opening 48, and a connecting portion. Preferably, surrounding portion 52 maintains a minimum distance from opening 48, as will be discussed below. Connecting portion 42 extends to a neighboring field emitter (shown in FIG. 3) of the same field emitter array. The emission voltage used to create the electric field for inducing electron emission in emitter 44 is applied between conductive layer 40 and substrate 32.

In operation, gate layer 36 localizes the effects of arcing between the gate layer 36 and the emitter 44. More particularly, by having a resistive substance 38 between the conductive layer 40 and the emitter 44, an arc path from the conductive layer 40 to the emitter is interrupted by a high resistance 38. Thus, when incorporated into an array, it is possible to resistively isolate arcing events to a single emitter 44. In the event that an arc occurs, resistive layer 38 operates to limit the arc/short circuit current between the conductive layer 40 of gate 36 and the substrate. By limiting the arc current, the effects of arcing may be limited to the field emitter 30 and may therefore not affect other emitters of the array. Furthermore, conductive layer 40 of gate 36 is able to maintain a more uniform potential for other emitters in the presence of an arc in a given emitter 30, such that the other emitters can continue electron emission. An additional benefit of using a conductive layer 40, such as a metal layer, is that the R—C time constant of the emitter is improved to result in faster switching of the emitter 30.

Figure 3:
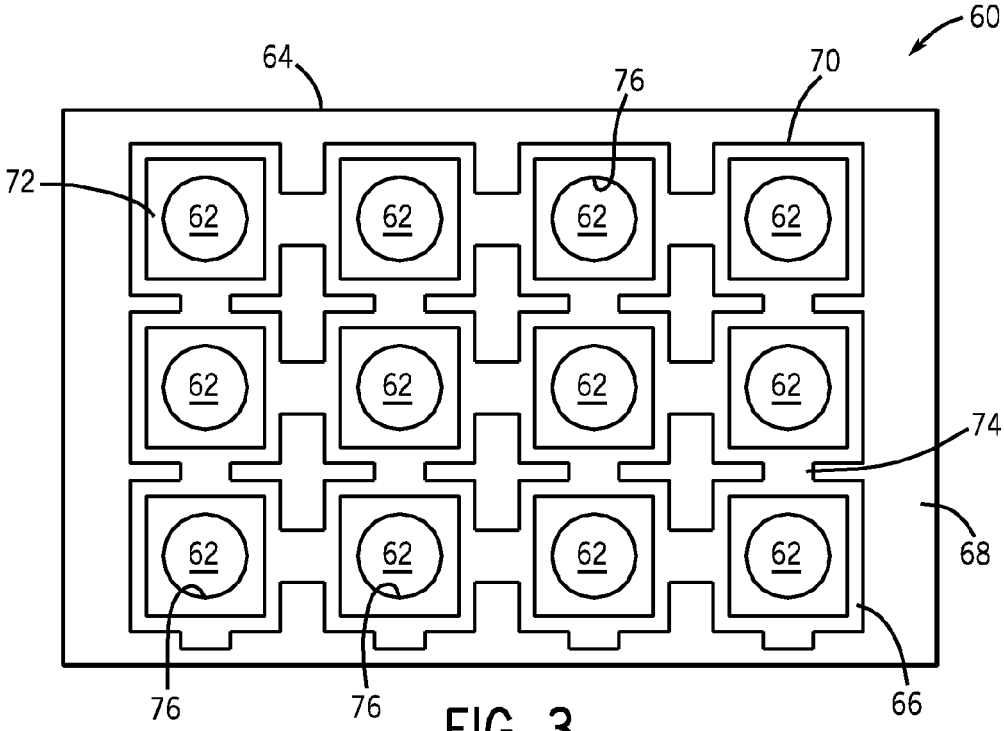
FIG. 3 is a top view of a field emitter array in accordance with an embodiment of the present invention.

Referring to FIG. 3, a top view of an array 60 of field emitters 62 is shown. Each field emitter 62 is of a design such as that shown in FIG. 2. The gate layer 64 of the field emitter array 60 is visible, and is common to all emitters 62 of the array 60. Gate layer 64 includes a resistive layer 68 and a metal or other conductive layer 66. The emission voltage used to induce electron emission of the array 60 is applied directly to conductive layer 66, across gate layer 64 and the substrate layer (not shown). As shown, conductive layer 66 may be printed in a grid pattern, having a number of rings or surrounding portions 70 and a number of connecting portions 74. As such, a potential applied across gate layer 64 and the substrate layer or base (not shown) of the array 60 will be generally uniform for each emitter 62.

As discussed above, the rings or surrounding portions 70 of the conductive grid layer 66 are spaced a distance 72 from the openings 76 of each emitter 62. By spacing the conductive rings 70 by distance 72, a portion of resistive layer 68 intervenes in an arc path from conductive layer 72 to the emitter tips (not shown) of each emitter. Therefore, the arc or short circuit current of a given emitter will be limited. A lower arc current will result in less potential for overheating, melting, or other current-related effects. However, since conductive layer 66 is not as resistive as resistive layer 68, and since the emission voltage of the array 60 is applied directly to the conductive layer 66, the emission voltage across other emitters 62 can be maintained, even when an arc occurs at one emitter 62.

Figure 4:
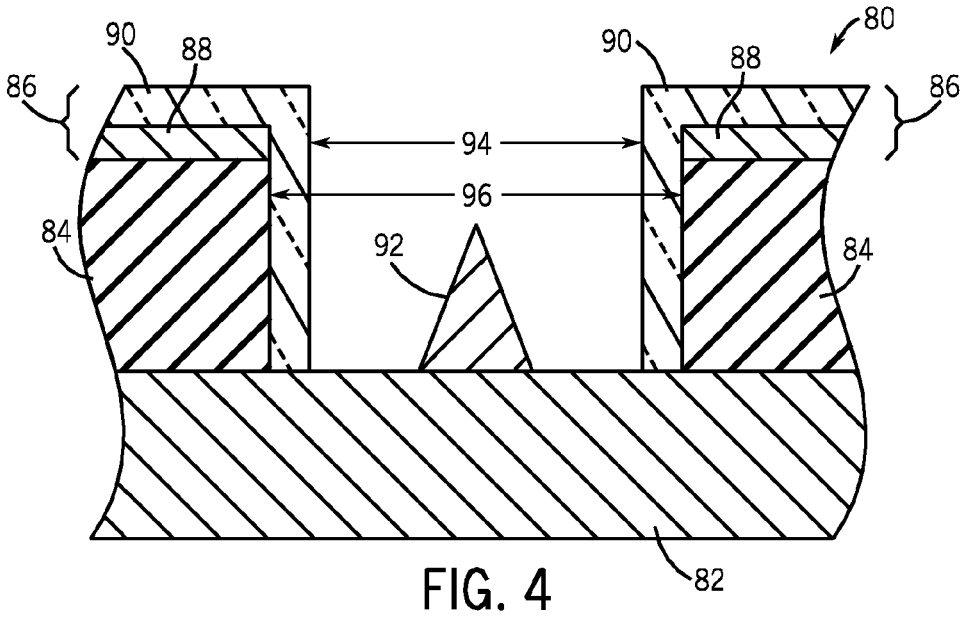
FIG. 4 is a cross-sectional view of an field emitter in accordance with another embodiment of the present invention.

Referring now to FIG. 4, a cross-sectional view of an emitter 80 in accordance with an alternative embodiment of the present invention is shown. Emitter 80 includes a substrate base 82, a dielectric layer 84 over the substrate base, and a gate layer 86 over the dielectric layer 84. A cavity or channel 94 is formed in the dielectric layer 84, and a corresponding opening 96 for channel 94 is formed in the gate layer 86. An emitter or tip 92 is disposed in channel 94, on substrate layer 82. Therefore, an emission voltage or potential may be applied across gate layer 86 and substrate layer 82 to create an electric field around opening 96 to induce emitter 92 to emit electrons.

In the embodiment of FIG. 4, gate layer 86 includes a metal or conductive layer 88 covered or surrounded by a resistive layer 90. As in the embodiment of FIG. 2, conductive layer 88 of FIG. 4 is preferably composed, at least in part, from molybdenum or another suitable substance to perform as a field emitter electrode. Conductive layer 88 is deposited onto dielectric layer 84, and resistive layer 90 is deposited over conductive layer 88. In this manner, the resistive layer 90 still intervenes between emitter 92 and conductive layer 88, but the arrangement and order of manufacture differ from the embodiments previously discussed. Therefore, it is understood that a variety of gate arrangements of resistive layers and conductive layers may be utilized in various embodiments of the present invention.

Accordingly, in one embodiment of the present invention a field emitter array includes a substrate layer, a dielectric layer, and a gate layer. The gate layer has a plurality of openings formed therethrough and the dielectric layer has a number of recesses therein. The gate layer also includes a resistive substance having an electrical resistance to localize arcing effects. The array also includes a plurality of emitters, each disposed in one of the recesses of the dielectric layer. The emitters are designed to emit electrons when an emission voltage is applied across the gate layer and the substrate layer.

The present invention is further embodied in a method for manufacturing a field emitter which includes providing a substrate base, depositing a dielectric on the substrate base, and forming a gate on the dielectric. A number of channels are created through the gate and the dielectric and an electron emitter tip is positioned in each. The method also includes arranging the gate to maintain electron emission from a number of the electron emitter tips when one electron emitter tip experiences a short circuit.

In accordance with another embodiment of the invention, an electron stream generator includes an electron emitter, a gate positioned to create an electric field sufficient to cause electron emission from the emitter, and a controller configured to selectively apply a potential across the gate and a substrate.

The present invention has been described in terms of the preferred embodiment, and it is recognized that equivalents, alternatives, and modifications, aside from those expressly stated, are possible and within the scope of the appending claims.

What is claimed is:

1. A field emitter array comprising:

a substrate layer;

a gate layer having a plurality of openings formed therethrough;

a dielectric layer between the substrate layer and the gate layer, the dielectric layer having a number of cavities therein extending to the substrate layer;

a plurality of emitters, each emitter disposed on the substrate layer in a cavity of the dielectric layer and designed to emit electrons when an emission voltage is applied across the gate layer and the substrate layer; and wherein the gate layer comprises a resistive layer and a conductive layer, said resistive layer having an electrical resistance to interrupt an arc path between the conductive layer and the emitter, wherein the resistive layer extends to the substrate layer and is between the conductive layer and the dielectric layer and the resistive layer is also between the conductive layer and the emitter disposed in the cavity.

2. The field emitter array of claim 1 wherein the plurality of openings formed through the gate layer and the number of cavities of the dielectric layer substantially overlap.

3. The field emitter array of claim 1 wherein the conductive layer is a metal grid formed on the resistive layer.

4. The field emitter array of claim 1 wherein the resistive layer at least partially intervenes between the conductive layer and each of the plurality of emitters.

5. The field emitter array of claim 1 wherein the gate layer is configured to maintain an electron emission voltage for a number of the plurality of emitters when one emitter is shorted.

6. The field emitter array of claim 1 wherein the resistive layer is a semiconductor layer.

7. The field emitter array of claim 6 wherein conductivity of the semiconductor layer is controlled by an amount of dopant, wherein the dopant is one of phosphorus (P) for an n-type semiconductor layer or boron (B) for a p-type semiconductor layer.

8. The field emitter array of claim 1 wherein the resistive layer is positioned to at least partially intervene between the gate layer and the emitters.

9. The field emitter array of claim 1 wherein the conductive layer is a grid pattern having a number of surrounding portions and a number of connecting portions, wherein there is a spaced distance between said emitters and said conductive layer such that a portion of the resistive layer intervenes an arc path from between the conductive layer and the emitter.

10. An electron stream generator comprising:

an electron emitter positioned upon a substrate; and a controller configured to selectively apply a potential across a gate layer and a substrate;

the gate layer positioned to create an electric field sufficient to cause electron emission from the emitter when the potential is applied thereto, and the gate layer comprising a resistive layer and a conductive layer, the resistive layer extending to said substrate and intervening between the conductive layer and the emitter.

11. The electron stream generator of claim 10 wherein the resistive layer is configured to limit short circuit arc current between the gate layer and the emitter.

12. The electron stream generator of claim 10 wherein the gate layer is a metal lithographed grid.

13. The electron stream generator of claim 10 wherein the resistive layer is configured to maintain operation of a number of other emitter elements when the given emitter element experiences arcing.

14. The electron stream generator of claim 10 wherein the resistive layer is positioned to at least partially intervene between the gate layer and the given emitter element.

* * * * *